US011266239B1

(12) United States Patent
Chen et al.

(10) Patent No.: US 11,266,239 B1
(45) Date of Patent: Mar. 8, 2022

(54) SLIDE RAIL ASSEMBLY

(71) Applicants: King Slide Works Co., Ltd., Kaohsiung (TW); King Slide Technology Co., Ltd., Kaohsiung (TW)

(72) Inventors: Ken-Ching Chen, Kaohsiung (TW); Shih-Lung Huang, Kaohsiung (TW); Yi-Syuan Jhao, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 17/102,710

(22) Filed: Nov. 24, 2020

(30) Foreign Application Priority Data

Aug. 19, 2020 (TW) ..... 109128520

(51) Int. Cl.

| | |
|---|---|
| ***A47B 88/49*** | (2017.01) |
| ***A47B 88/57*** | (2017.01) |
| ***A47B 88/477*** | (2017.01) |
| ***A47B 88/473*** | (2017.01) |
| ***A47B 88/483*** | (2017.01) |

(52) U.S. Cl.
CPC ..... *A47B 88/49* (2017.01); *A47B 88/477* (2017.01); *A47B 88/57* (2017.01); *A47B 88/473* (2017.01); *A47B 88/483* (2017.01)

(58) Field of Classification Search
CPC ... A47B 88/473; A47B 88/423; A47B 88/477; A47B 88/483; A47B 88/49; A47B 88/57
See application file for complete search history.

(56) References Cited

U.S. PATENT DOCUMENTS

| | | | | | |
|---|---|---|---|---|---|
| 4,610,487 | A * | 9/1986 | Delmege | A47B 88/57 | 384/18 |
| 4,696,582 | A * | 9/1987 | Kasten | A47B 88/493 | 384/18 |
| 5,181,782 | A * | 1/1993 | Wojcik | A47B 88/493 | 384/21 |
| 5,466,060 | A * | 11/1995 | Hoffman | A47B 88/493 | 312/334.11 |
| 5,507,571 | A * | 4/1996 | Hoffman | A47B 88/493 | 312/334.16 |

(Continued)

FOREIGN PATENT DOCUMENTS

| | | | |
|---|---|---|---|
| CN | 1432325 | A | 7/2003 |
| CN | 100515272 | A | 1/2006 |

(Continued)

*Primary Examiner* — Hanh V Tran
(74) *Attorney, Agent, or Firm* — Karin L. Williams; Alan D. Kamrath; Mayer & Williams PC

(57) ABSTRACT

A slide rail assembly includes a first rail, a second rail, a working member and a contact feature. The second rail and the first rail are movable relative to each other. The working member is mounted to a connecting part arranged on one of the first rail and the second rail. The contact feature is arranged on the other one of the first rail and the second rail. At least one space is defined between the working member and the connecting part. When the slide rail assembly is in a retracted state, the working member is configured to block the contact feature, in order to prevent the second rail from being moved from a predetermined position along one direction.

10 Claims, 13 Drawing Sheets

(56) References Cited

U.S. PATENT DOCUMENTS

| | | | | | |
|---|---|---|---|---|---|
| 5,551,775 | A * | 9/1996 | Parvin | A47B 88/493 | 312/334.11 |
| 6,145,944 | A * | 11/2000 | Bayani | A47B 88/493 | 312/334.11 |
| 6,244,678 | B1 | 6/2001 | Dopp et al. | | |
| 6,254,209 | B1 * | 7/2001 | Parvin | A47B 88/493 | 312/334.11 |
| 6,257,683 | B1 * | 7/2001 | Yang | A47B 88/487 | 312/333 |
| 6,382,751 | B1 * | 5/2002 | Chiu | A47B 88/487 | 312/334.11 |
| 7,086,708 | B2 | 8/2006 | Tseng et al. | | |
| 9,661,925 | B2 * | 5/2017 | Uffner | A47B 88/493 | |
| 9,675,175 | B1 * | 6/2017 | Chen | A47B 88/57 | |
| 2006/0028104 | A1 * | 2/2006 | Tseng | A47B 88/40 | 312/334.44 |
| 2009/0284115 | A1 * | 11/2009 | Huang | A47B 88/57 | 312/334.44 |
| 2012/0169199 | A1 * | 7/2012 | Chen | A47B 88/57 | 312/334.44 |
| 2013/0077900 | A1 * | 3/2013 | Lowe | A47B 88/49 | 384/18 |
| 2017/0007020 | A1 * | 1/2017 | McElveen | A47B 88/493 | |
| 2018/0289155 | A1 * | 10/2018 | Hutton | A47B 88/423 | |
| 2021/0093083 | A1 * | 4/2021 | Chen | A47B 88/493 | |

FOREIGN PATENT DOCUMENTS

| | | | | | |
|---|---|---|---|---|---|
| CN | 110664141 | A * | 1/2020 | | |
| CN | 111616532 | A * | 9/2020 | | |
| DE | 20011580 | U1 * | 1/2001 | A47B 88/487 | |
| EP | 768050 | A2 * | 4/1997 | | |
| JP | 2004147755 | A * | 5/2004 | | |

* cited by examiner

SLIDE RAIL ASSEMBLY

BACKGROUND OF THE INVENTION

1. Field of the Invention

The present invention relates to a slide rail assembly, and more particularly, to a slide rail assembly capable of stably staying in a retracted state at a retracted position.

2. Description of the Prior Art

China patent number CN100515272C discloses a buffering and positioning device for slide rail, which is applied to a fixed rail and a movable rail movable relative to the fixed rail. A vertical sheet body is arranged at a rear end of the fixed rail for being sleeved with a buffer member. The buffer member is configured to provide buffer for the movement of the movable rail when the movable rail is retracted relative to the fixed rail. When the movable rail is retracted, the movable rail can be further positioned and engaged with the buffer member. The buffer member is arranged with a straight sleeve groove, such that cross-sectional shapes of two ends of the buffer member have identical widths. A connecting part is arranged on the buffer member. The connecting part is located at a center part of one inner side surface of the sleeve groove and formed into a protrusion. Two sides of the sheet body are flat and straight. A through hole is arranged at the center of the sheet body corresponding to the protruded connecting part of the buffer member, such that the structures of protrusion and hole can be fitted with each other.

However, the sleeve groove of the buffer member has a straight contour. When the sleeve groove of the buffer member is sleeved on the contour-matched sheet body of the fixed rail, the sleeve groove of the buffer member and the sheet body of the fixed rail are tightly matched and fitted, so that the buffer member does not have additional space for flexible deformation. As such, during a process of the movable rail being moved relative to the fixed rail from the retracted position to an open position (or from the open position to the retracted position), a clamping part (a clamping point shown in FIG. 3 of the aforementioned patent) at a rear end of the movable rail is in frictional contact with the buffer member, so as to cause the clamping part (the clamping point) of the buffer member to wear down easily, such that the positioning function between the movable rail and the buffer member is failed.

Therefore, it is important to develop a slide rail assembly to meet specific market requirements.

SUMMARY OF THE INVENTION

The present invention relates to a slide rail assembly capable of being held at a retracted position in a retracted state.

According to an embodiment of the present invention, a slide rail assembly comprises a first rail, a second rail, a working member and a contact feature. The second rail is longitudinally movable relative to the first rail. The working member is mounted to a connecting part arranged on one of the first rail and the second rail. The contact feature is arranged on the other one of the first rail and the second rail. The connecting part has a first side, and a first space is defined between the working member and the first side of the connecting part. During a process of the second rail being moved relative to the first rail from a first predetermined position to a second predetermined position along a first direction, the contact feature is configured to contact the working member, such that the working member is flexibly deformed through the first space, in order to allow the contact feature to cross the working member along the first direction.

Preferably, the working member is made of a flexible material. The connecting part further has a second side opposite to the first side, and a second space is defined between the working member and the second side of the connecting part. During a process of the second rail being moved relative to the first rail from the second predetermined position to the first predetermined position along a second direction opposite to the first direction, the contact feature is configured to contact the working member, such that the working member is flexibly deformed through the second space, in order to allow the contact feature to cross the working member along the second direction.

Preferably, a first longitudinal distance is defined between the first side of the connecting part and a first edge wall of the working member in the first space, and a second longitudinal distance is defined between the second side of the connecting part and a second edge wall of the working member in the second space. The first longitudinal distance is substantially shorter than the second longitudinal distance.

Preferably, the working member comprises a first part, a second part and a middle part connected between the first part and the second part. A first clamping feature is arranged between the first part and the middle part and configured to clamp the first side and the second side of the connecting part.

Preferably, the middle part has a supporting section configured to abut against one of the first side and the second side of the connecting part.

Preferably, the working member has a foolproof mechanism configured to prevent the working member from being mounted to the connecting part incorrectly.

Preferably, each of the first rail and the second rail comprises a first wall, a second wall and a longitudinal wall connected between the first wall and the second wall. The working member is arranged with a guiding structure. During the process of the second rail being moved relative to the first rail from the second predetermined position to the first predetermined position along the second direction, the guiding structure of the working member is configured to guide the longitudinal wall of the second rail, such that the longitudinal wall of the second rail is configured to be supported by the working member.

According to another embodiment of the present invention, a slide rail assembly comprises a first rail, a second rail, a working member and a contact feature. The second rail is movable relative to the first rail. The working member is detachably mounted to a connecting part of the first rail. The contact feature is arranged on the second rail. A first space is defined between the working member and the connecting part. When the second rail is moved relative to the first rail along a first direction from a retracted state, the working member is configured to block the contact feature in order to prevent the second rail from being moved from a first predetermined position along the first direction.

Preferably, the working member has a first guiding section. During a process of the second rail being moved relative to the first rail from the first predetermined position to a second predetermined position along the first direction, the contact feature is configured to contact the first guiding section of the working member, such that the working member is flexibly deformed through the first space, in order to allow the contact feature to cross the working member.

Preferably, a second space is defined between the working member and the connecting part. The working member further has a second guiding section. During a process of the second rail being moved relative to the first rail from the second predetermined position to the first predetermined position along a second direction opposite to the first direction, the contact feature is configured to contact the second guiding section of the working member, such that the working member is flexibly deformed through the second space, in order to allow the contact feature to cross the working member.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
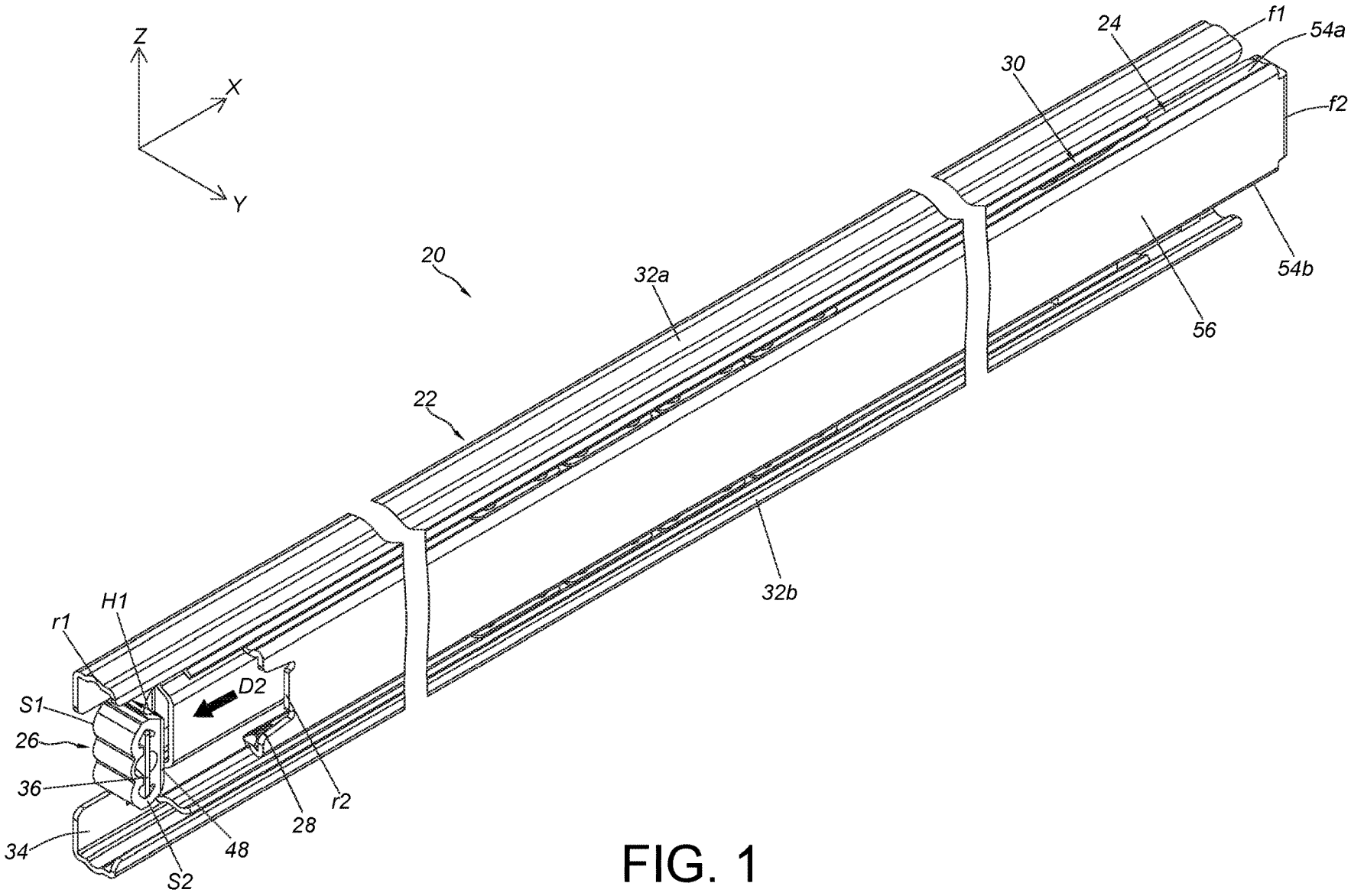
FIG. 1 is a diagram showing a slide rail assembly according to an embodiment of the present invention.
Figure 2:
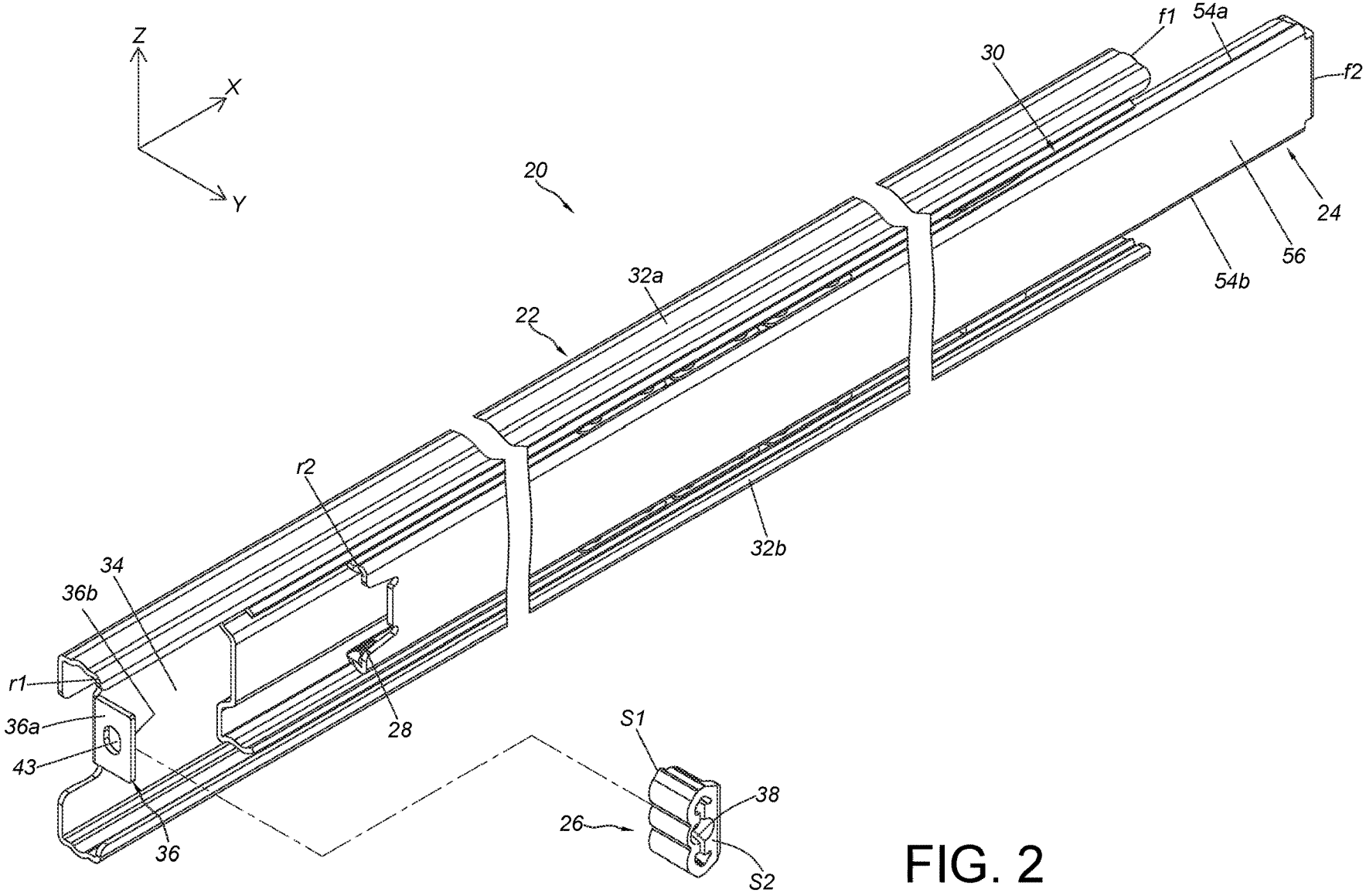
FIG. 2 is an exploded view of a working member and the slide rail assembly according to an embodiment of the present invention.

As shown in FIG. 1 and FIG. 2, a slide rail assembly 20 comprises a first rail 22, a second rail 24, a working member 26 and at least one contact feature 28 according to an embodiment of the present invention. Preferably, the slide rail assembly 20 further comprises a third rail 30 movably mounted between the first rail 22 and the second rail 24, so as to form a so-called three-sectional slide rail assembly 20. The first rail 22, the second rail 24 and the third rail 30 are longitudinally movable relative to each other. Moreover, in the present embodiment, an X-axis direction is defined as a longitudinal direction (or a longitudinal direction or moving direction of the rail), a Y-axis direction is defined as a transverse direction, and a Z-axis direction is defined as vertical direction (or a height direction of the rail).

The first rail 22 comprises a first wall 32*a*, a second wall 32*b* and a longitudinal wall 34 connected between the first wall 32*a* and the second wall 32*b* of the first rail 22. A passage is defined by the first wall 32*a*, the second wall 32*b* and the longitudinal wall 34 of the first rail 22 for accommodating the third rail 30. The first rail 22 has a first end part and a second end part away from the first end part. The first end part can be a front end part f1, and the second end part can be a rear end part r1, but the present invention is not limited thereto. Similarly, another passage is defined by a plurality of walls of the third rail 30 for accommodating the second rail 24. The second rail 24 comprises a first wall 54*a*, a second wall 54*b* and a longitudinal wall 56 connected between the first wall 54*a* and the second wall 54*b* of the second rail 24. The second rail 24 has a first end part and a second end part away from the first end part. The first end part of the second rail 24 can be a front end part f2, and the second end part of the second rail 24 can be a rear end part r2, but the present invention is not limited thereto.

The working member 26 is mounted to a connecting part 36 arranged on one of the first rail 22 and the second rail 24. In the present embodiment, the connecting part 36 is arranged on the first rail 22, and is located adjacent to the rear end part r1 of the first rail 22. Preferably, the connecting part 36 is a protrusion substantially transversely protruded from the longitudinal wall 34 of the first rail 22, but the present invention is not limited thereto. The working member 26 is arranged on the connecting part 36. The at least one contact feature 28 is arranged on the other one of the first rail 22 and the second rail 24. In the present embodiment, the at least one contact feature 28 is arranged adjacent to the rear end part r2 of the second rail 24. In addition, in the present embodiment, two contact features 28 are respectively arranged on the first wall 54*a* and the second wall 54*b* of the second rail 24.

Preferably, the working member 26 is detachably mounted to the connecting part 36.

Preferably, the working member 26 is made of a flexible material. For example, the working member 26 can be made of a plastic material, but the present invention is not limited thereto.

Figure 3:
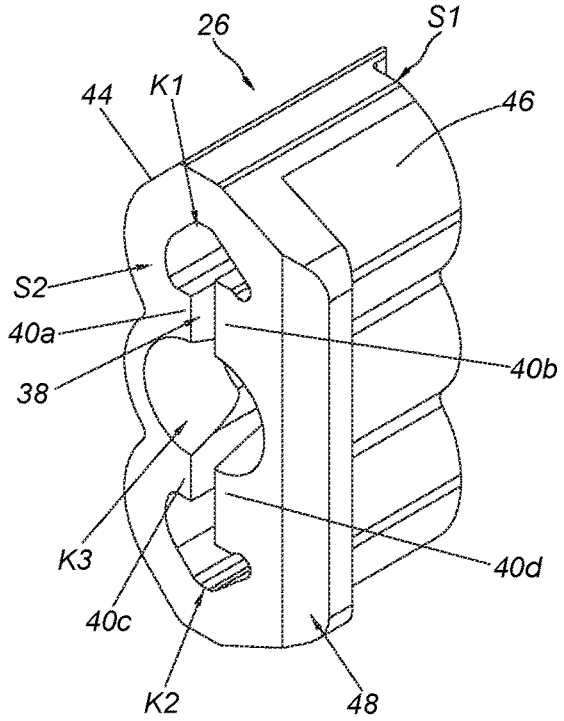
FIG. 3 is a diagram showing the working member from a viewing angle according to an embodiment of the present invention.

Preferably, the working member 26 has a mounting part 38 configured to be mounted to the connecting part 36, and the mounting part 38 and the connecting part 36 have corresponding contours substantially matching each other. In the present embodiment, the mounting part 38 is formed with an opening penetrating through a first side S1 and a second side S2 of a main body of the working member 26 (please refer to FIG. 3 and FIG. 4), and the connecting part 36 is a protrusion, but the present invention is not limited thereto. The working member 26 is configured to be sleeved on the connecting part 36 through the mounting part 38.

The connecting part 36 has a first side 36*a* and a second side 36*b* opposite to the first side 36*a*, such as a rear side and a front side, but the present invention is not limited thereto. A first space G1 is defined between the working member 26 and the first side 36*a* of the connecting part 36 (please refer to FIG. 6). On the other hand, a second space G2 is defined between the working member 26 and the second side 36*b* of the connecting part 36. Preferably, a first longitudinal distance L1 is defined between the first side 36*a* of the connecting part 36 and a first edge wall W1 of the working member 26 in the first space G1 (please refer to FIG. 6A), and a second longitudinal distance L2 is defined between the second side 36*b* of the connecting part 36 and a second edge wall W2 of the working member 26 in the second space G2 (please refer to FIG. 6A). The first longitudinal distance L1 is substantially smaller than the second longitudinal distance L2. Therefore, the working member 26 has different deformation levels at the two sides of the connecting part 36. For example, the deformation level (or deformation degree) of the working member 26 adjacent to the second space G2 is greater than the deformation level (or deformation degree) of the working member 26 adjacent to the first space G1.

Preferably, the working member 26 comprises a first part K1, a second part K2 and a middle part K3 connected between the first part K1 and the second part K2 (please refer to FIG. 5 and FIG. 6), and the first part K1 and the second part K2 have substantially identical configuration. A first clamping feature is arranged between the first part K1 and the middle part K3. For example, the first clamping feature includes a first auxiliary section 40*a* and a second auxiliary section 40*b* configured to clamp the first side 36*a* and the second side 36*b* of the connecting part 36. Similarly, a second clamping feature is arranged between the second part K2 and the middle part K3. For example, the second clamping feature includes a third auxiliary section 40*c* and a fourth auxiliary section 40*d* configured to clamp the first side 36*a* and the second side 36*b* of the connecting part 36.

Preferably, the middle part K3 of the working member 26 has a supporting section 42 (please refer to FIG. 6), such as a protrusion section, configured to abut against one of the first side 36*a* and the second side 36*b* of the connecting part 36. In the present embodiment, the supporting section 42 is configured to abut against the second side 36*b* of the connecting part 36, such that the working member 26 can be tightly pressed to the connecting part 36. Preferably, the connecting part 36 has a through hole 43, and the supporting section 42 of the working member 26 is engaged with an edge wall of the through hole 43, so as to improve reliability of the working member 26 being mounted to the connecting part 36.

Figure 6:
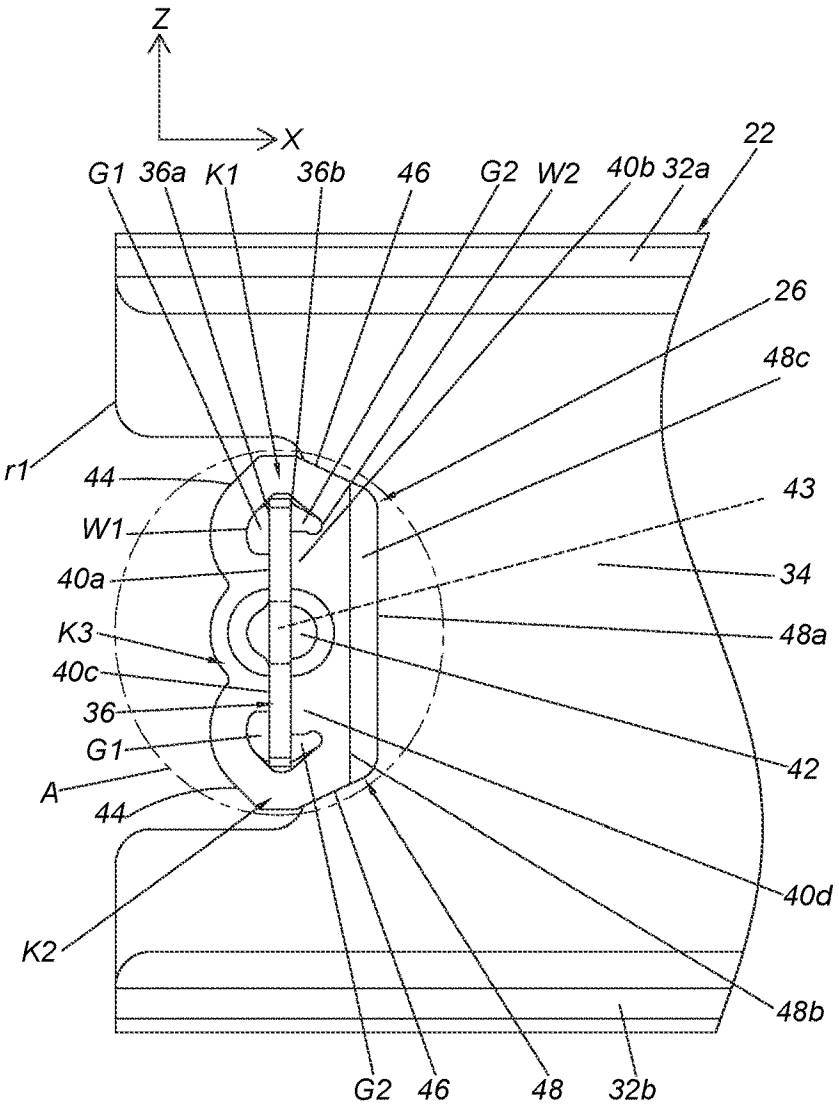
FIG. 6 is a diagram showing the working member being correctly mounted to a first rail of the slide rail assembly according to an embodiment of the present invention.
Figure 5:
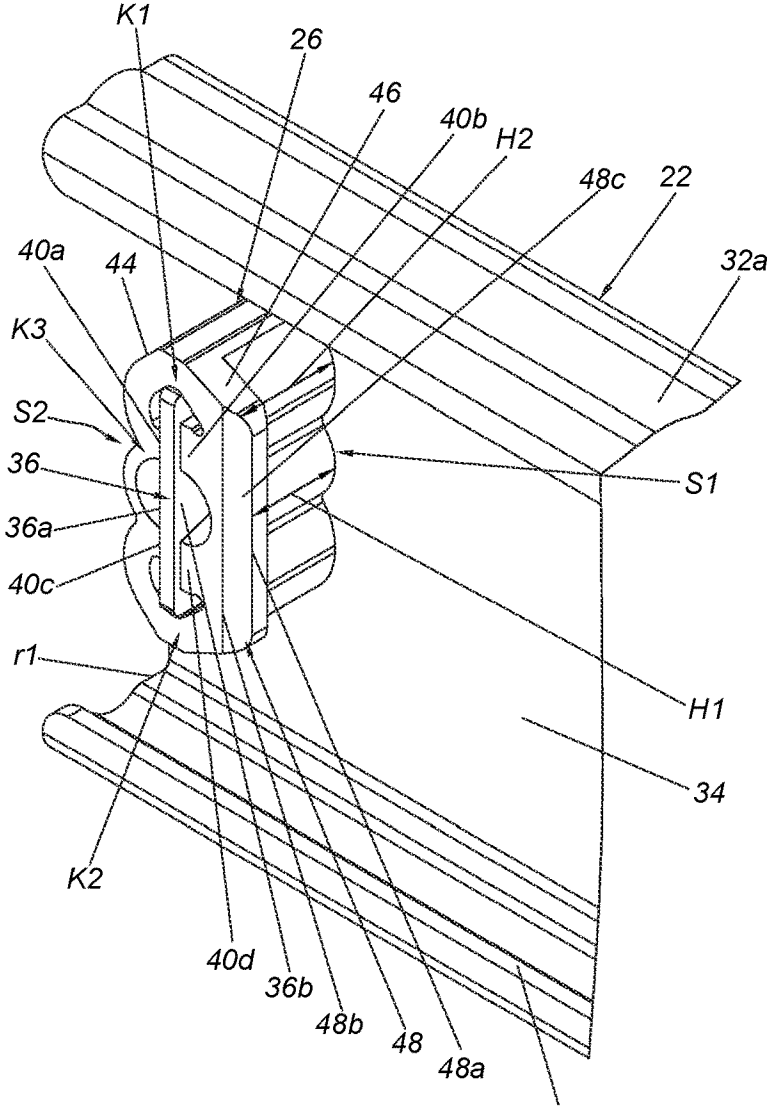
FIG. 5 is a diagram showing the working member being correctly mounted to a first rail of the slide rail assembly according to an embodiment of the present invention.
Figure 6A:
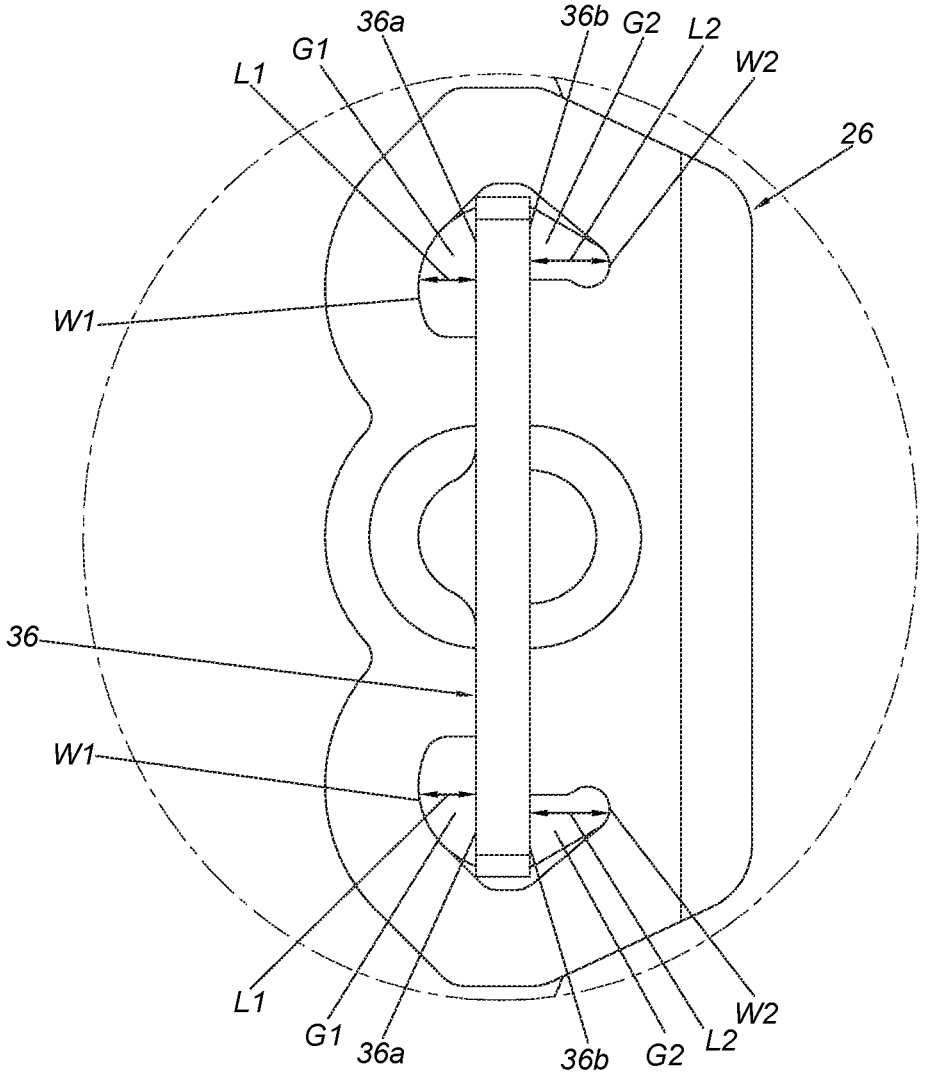
FIG. 6A is an enlarged view of an area A of FIG. 6.

Preferably, a rear half body and a front half body of the working member 26 are respectively provided with a first guiding section 44 (such as an inclined surface or an arc surface shown in FIG. 5 and FIG. 6) and a second guiding section 46 (such as an inclined surface or an arc surface shown in FIG. 5 and FIG. 6). In the present embodiment, both the first part K1 and the second part K2 of the working member 26 have the first guiding section 44 and the second guiding section 46, but the present invention is not limited thereto.

Preferably, each of the first guiding section 44 and the second guiding section 46 has an inclined surface or an arc surface, and the first guiding section 44 is slightly steeper than the second guiding section 46.

Preferably, a front half part of the second side S2 of the working member 26 is arranged with a guiding structure 48 (such as an inclined surface or an arc surface shown in FIGS. 3, 4 and 5), and the guiding structure 48 is provided with a lower part 48*a*, a higher part 48*b*, and a guiding part 48*c* connected between the lower part 48*a* and the higher part 48*b*. A first transverse height H1 (or a first lateral height) is defined between the lower part 48*a* and the first side S1 of the working member 26, and a second transverse height H2 (or a second lateral height) is defined between the higher part 48*b* and the first side S1 of the working member 26.

Preferably, a transverse distance between the longitudinal wall 56 of the second rail 24 and the longitudinal wall 34 of the first rail 22 is substantially greater than the first transverse height H1 (please also refer to FIG. 1), and the second transverse height H2 is greater than the transverse distance between the longitudinal wall 56 of the second rail 24 and the longitudinal wall 34 of the first rail 22. Moreover, a transverse height between a rear half part of the second side S2 and the first side S1 of the working member 26 is substantially equal to the second transverse height H2.

Figure 7:
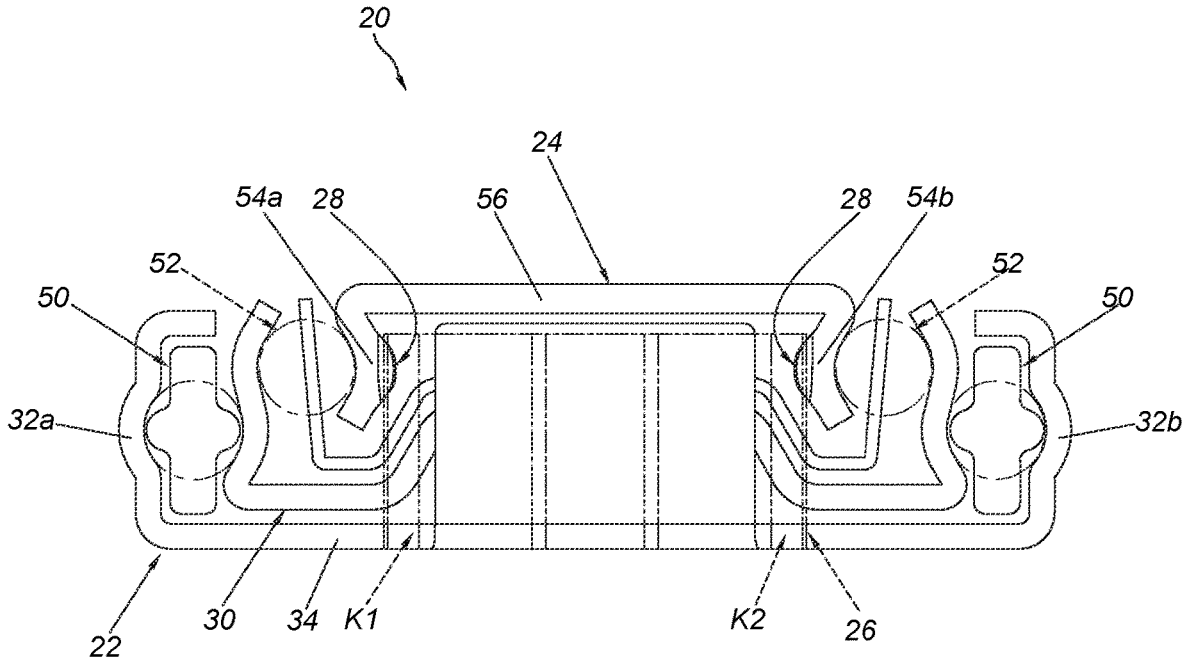
FIG. 7 is a cross-sectional view of the slide rail assembly comprising the first rail, a second rail, a third rail and the working member according to an embodiment of the present invention.
Figure 8:
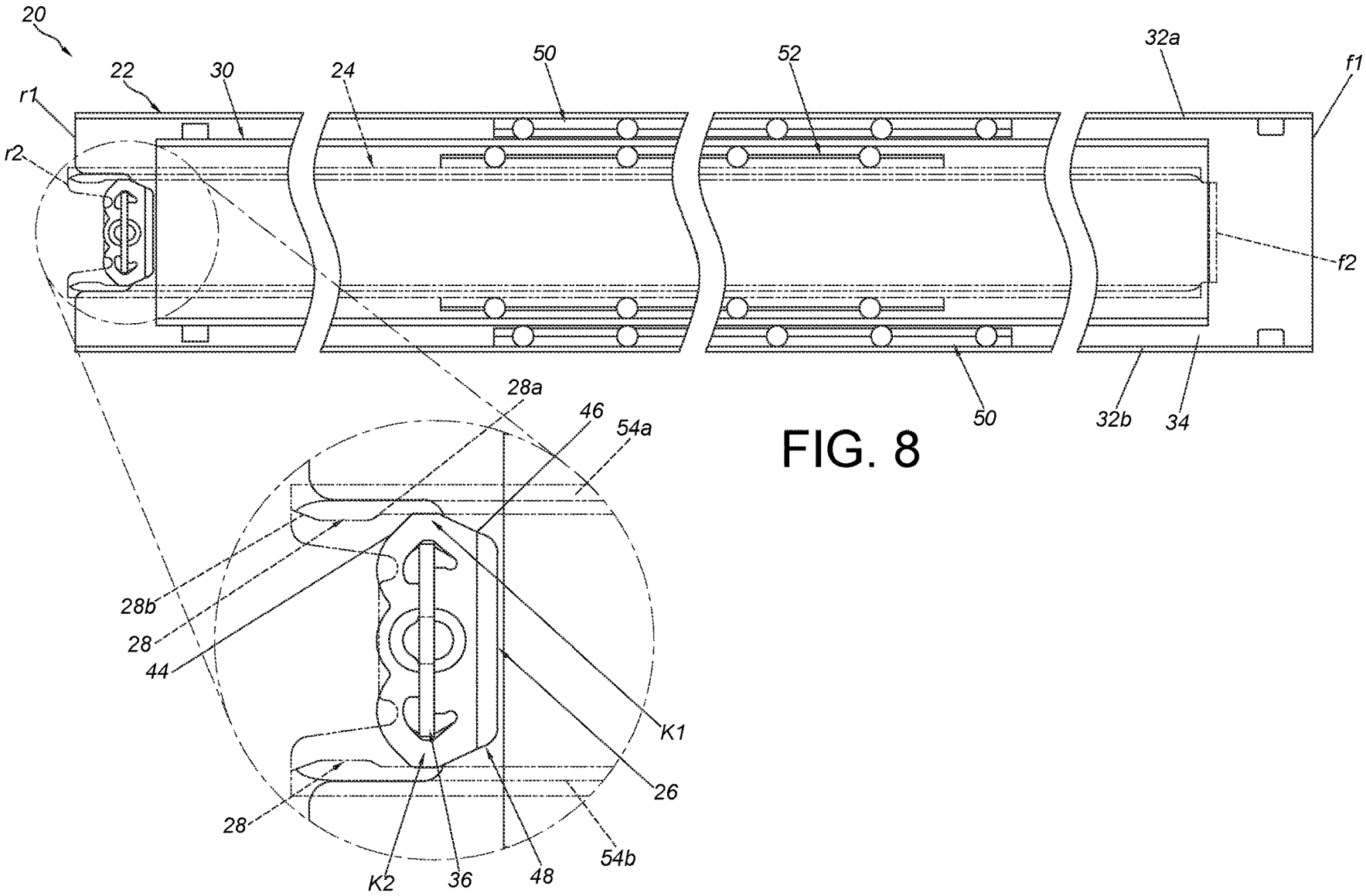
FIG. 8 is a diagram showing the slide rail assembly being in a retracted state according to an embodiment of the present invention.

As shown in FIG. 7 and FIG. 8, a slide assisting device is arranged between each two adjacent rails of the slide rail assembly 20. The slide assisting device is arranged with a plurality of balls. In the present embodiment, a first slide assisting device 50 is movably arranged between the first rail 22 and the third rail 30, and configured to improve smoothness of relative movement between the first rail 22 and the third rail 30. Similarly, a second slide assisting device 52 is movably arranged between the third rail 30 and the second rail 24 and configured to improve smoothness of relative movement between the third rail 30 and the second rail 24.

Preferably, the two contact features 28 are configured to respectively interact with the first part K1 and the second part K2 of the working member 26. The two contact features 28 have substantially identical configuration. For example, each contact feature 28 has a front contact part 28*a* and a rear contact part 28*b* (as shown in FIG. 8). Preferably, each of the front contact part 28*a* and the rear contact part 28*b* has an inclined surface or an arc surface. When the slide rail assembly 20 is in a retracted state, the second rail 24 (and the third rail 30) is retracted relative to the first rail 22.

Figure 9:
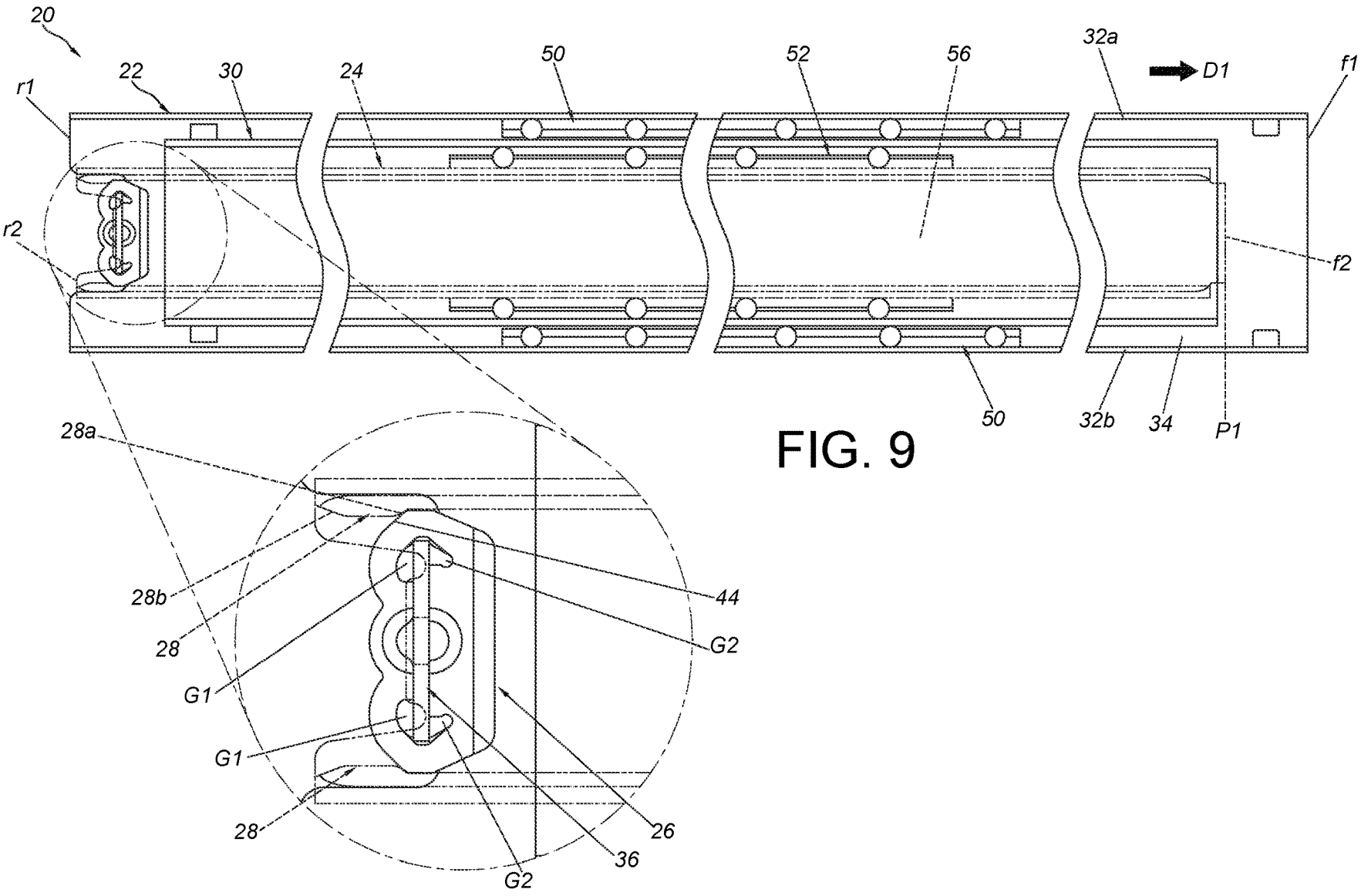
FIG. 9 is a diagram showing the second rail of the slide rail assembly being moved relative to the first rail along a first direction according to an embodiment of the present invention.

As shown in FIG. 9, when the second rail 24 (and the third rail 30) is moved relative to the first rail 22 along a first direction D1 in an unexpected manner (such as being moved by gravity due to inclination), the first guiding section 44 of the working member 26 is configured to block the contact feature 28 in order to prevent the second rail 24 from being moved from a first predetermined position P1 (such as a retracted position) along the first direction D1.

Figure 10:
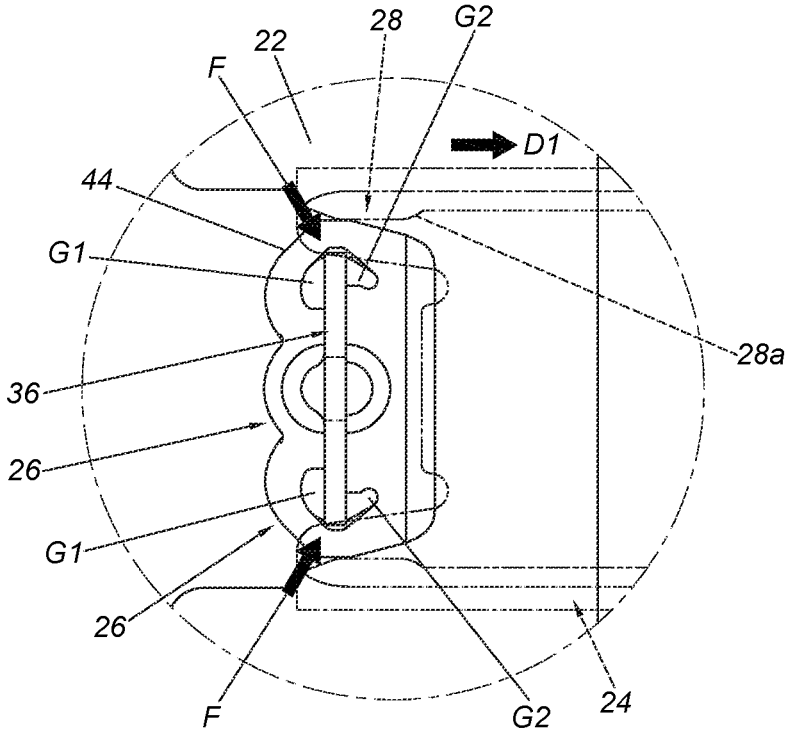
FIG. 10 is a partial view of the slide rail assembly when the second rail is further moved relative to the first rail along the first direction according to an embodiment of the present invention.
Figure 11:
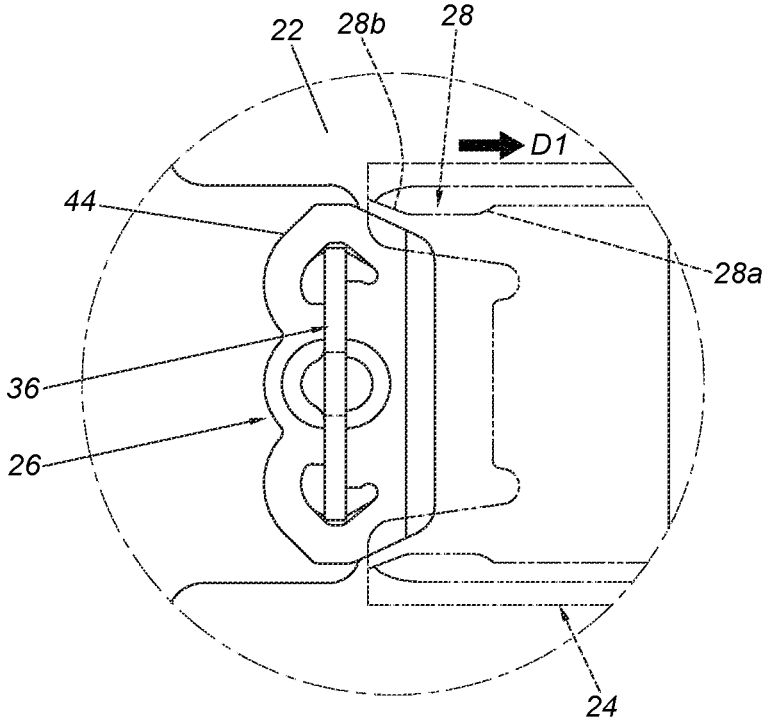
FIG. 11 is a partial view of the slide rail assembly when the second rail is further moved relative to the first rail along the first direction according to an embodiment of the present invention.
Figure 12:
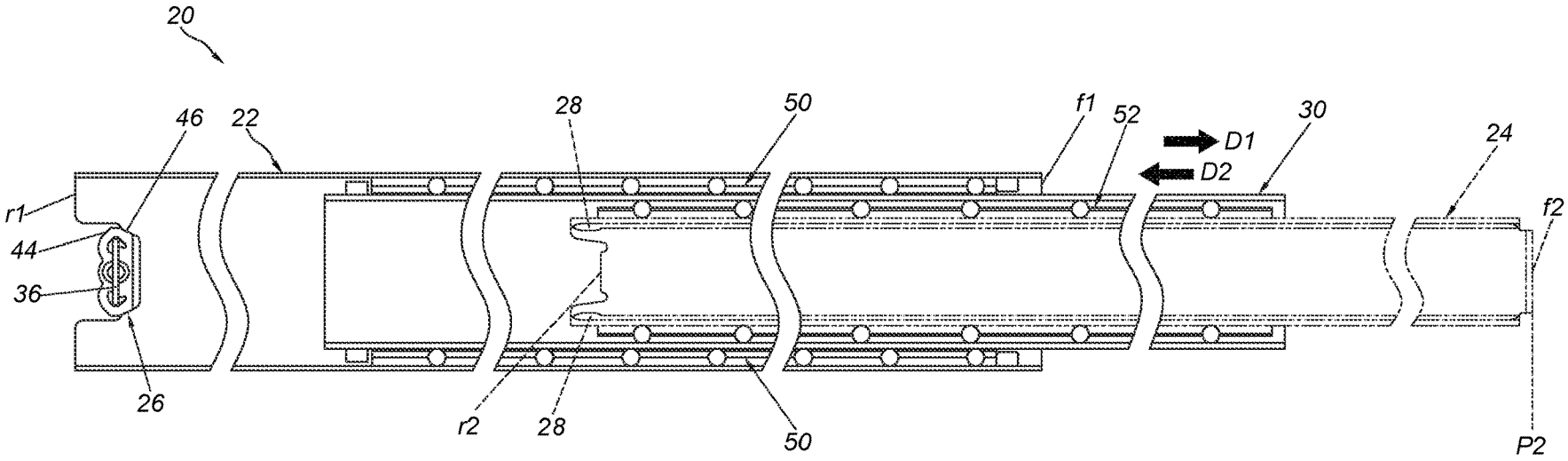
FIG. 12 is a diagram showing the slide rail assembly being in an extended state according to an embodiment of the present invention.

As shown in FIG. 9 to FIG. 12, during a process of the second rail 24 being moved relative to the first rail 22 from the first predetermined position P1 along the first direction D1, the front contact part 28*a* of the contact feature 28 is configured to contact the first guiding section 44 of the working member 26 (as shown in FIG. 9). Once a force applied by a user to the second rail 24 in the first direction D1 is large enough, the front contact part 28*a* of the contact feature 28 and the first guiding section 44 of the working member 26 contact each other, such that the working member 26 is flexibly deformed through the first space G1. In other words, the working member 26 generates a flexible deformation force F (as shown in FIG. 10) and allows the contact feature 28 to cross the working member 26 along the first direction D1 (as shown in FIG. 11), such that the second rail 24 can be moved relative to the first rail 22 along the first direction D1 to a second predetermined position P2 (as shown in FIG. 12). In the meantime, the slide rail assembly 20 is in an extended state.

Figure 13:
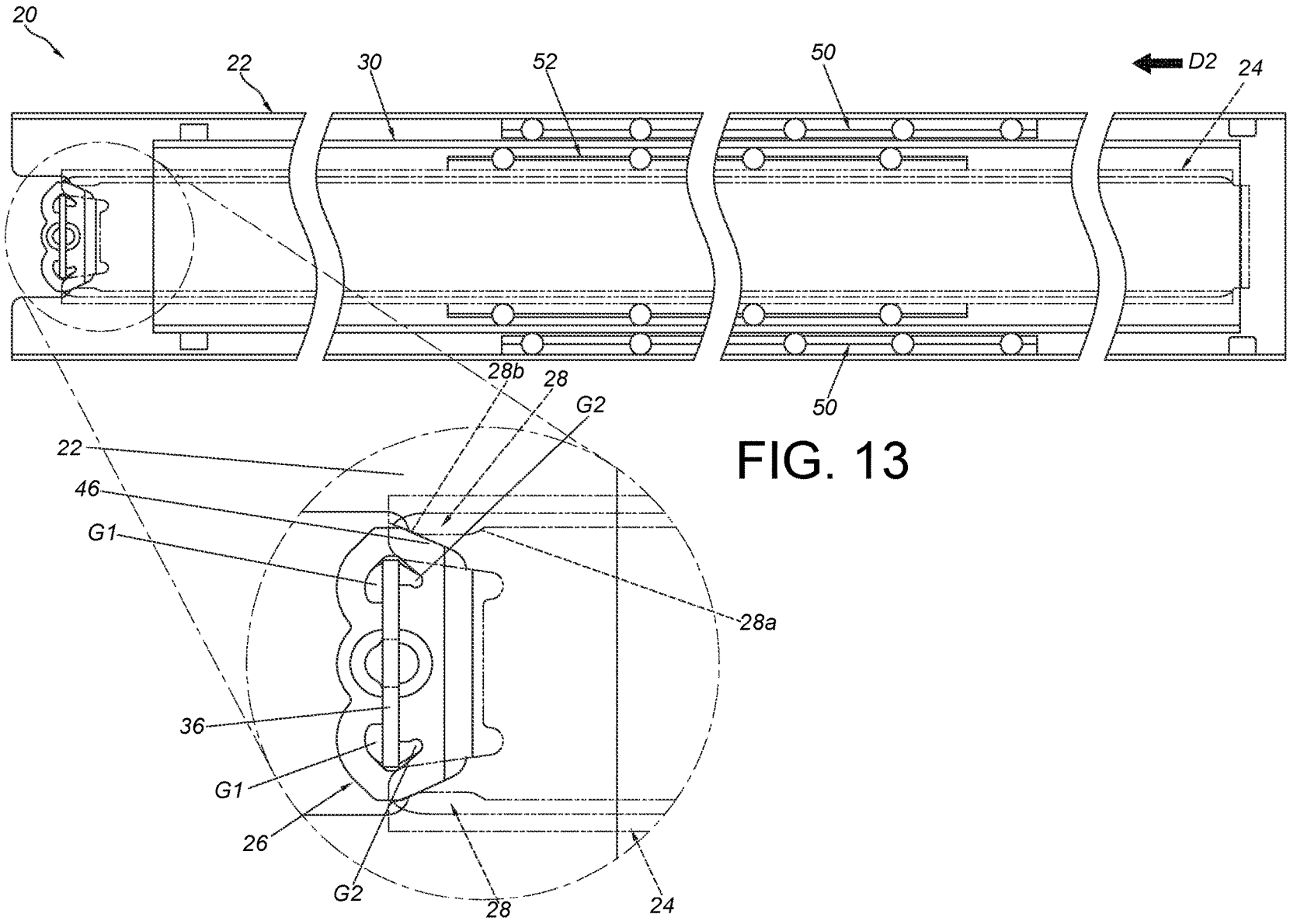
FIG. 13 is a diagram showing the second rail of the slide rail assembly being moved relative to the first rail along a second direction according to an embodiment of the present invention.
Figure 14:
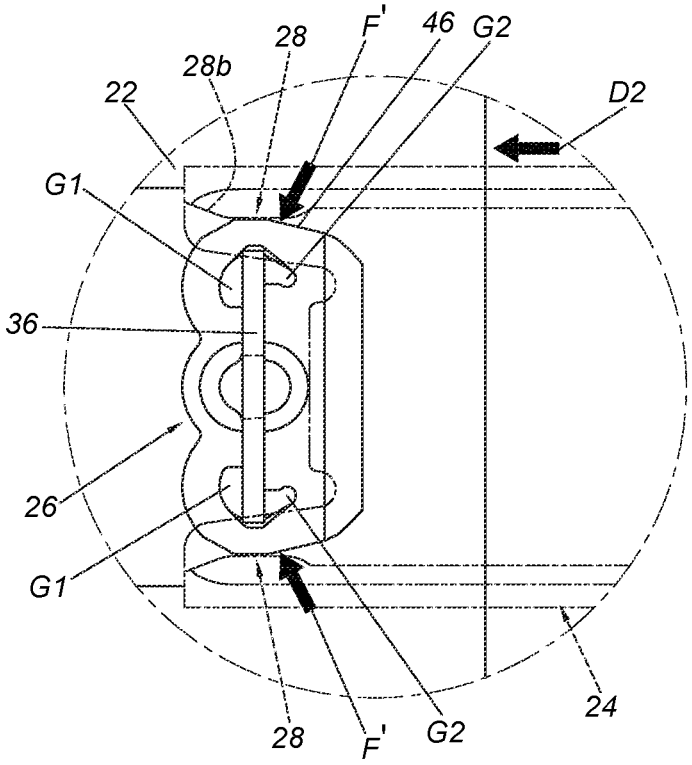
FIG. 14 is a diagram showing the second rail of the slide rail assembly being further moved relative to the first rail along the second direction according to an embodiment of the present invention.

As shown in FIG. 12 to FIG. 14, during a process of the second rail 24 being moved relative to the first rail 22 from the second predetermined position P2 along a second direction D2 opposite to the first direction D1, the rear contact part 28*b* of the contact feature 28 is configured to contact the second guiding section 46 of the working member 26 (as shown in FIG. 13) for buffering, so as to reduce collision noise in the process of the second rail 24 being retracted relative to the first rail 22. Once a force applied by the user to the second rail 24 in the second direction D2 is large enough, the rear contact part 28*b* of the contact feature 28 and the second guiding section 46 of the working member 26 contact each other, such that the working member 26 is flexibly deformed through the second space G2 and/or the first space G1 (as shown in FIG. 14). In other words, the working member 26 generates another flexible deformation force F' and allow the contact feature 28 to cross the working member 26 along the second direction D2, such that the second rail 24 can be moved relative to the first rail 22 along the second direction D2 to the first predetermined position P1 (as shown in FIG. 9 or FIG. 8).

Moreover, as shown in FIG. 1, during the process of the second rail 24 being moved relative to the first rail 22 from the second predetermined position P2 to the first predetermined position P1 along the second direction D2, the guiding structure 48 of the working member 26 is configured to guide the longitudinal wall 56 of the rear end part r2 of the second rail 24, so that the longitudinal wall 56 of the second rail 24 can be supported by the second side S2 of the working member 26 when the second rail 24 returns to the first predetermined position P1 (as shown in FIG. 9).

Figure 15:
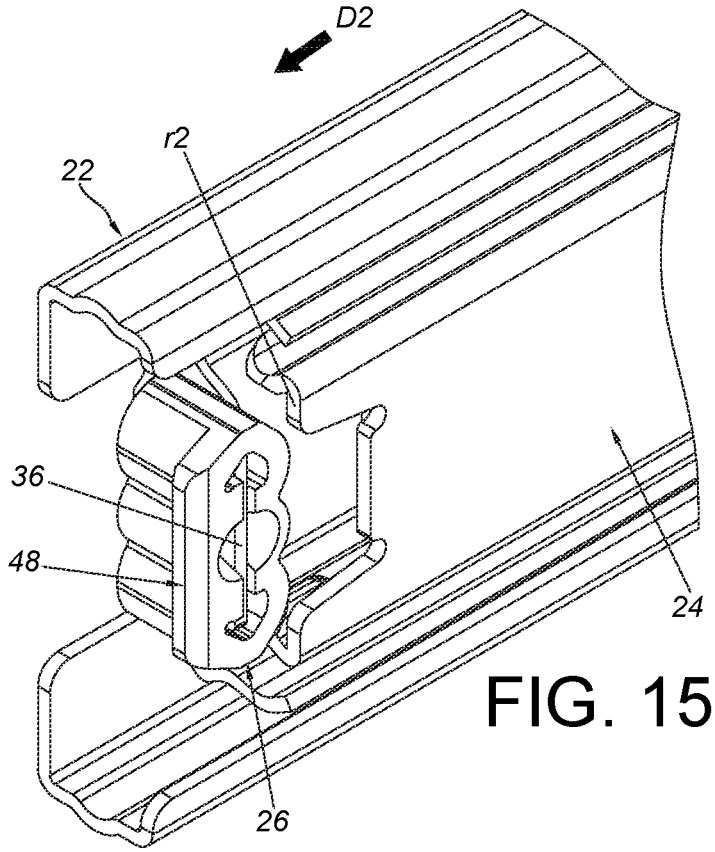
FIG. 15 is a diagram showing the working member being incorrectly mounted to the first rail of the slide rail assembly according to an embodiment of the present invention.
Figure 16:
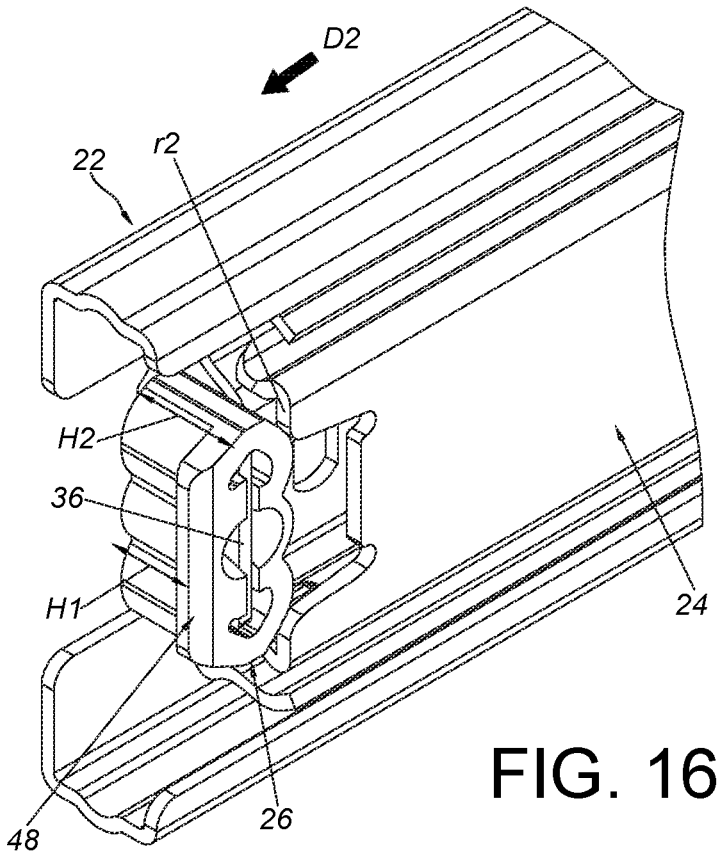
FIG. 16 is a diagram showing the working member being incorrectly mounted to the first rail of the slide rail assembly to cause the second rail unable to be smoothly retracted relative to the first rail along the second direction according to an embodiment of the present invention.

As shown in FIG. 15, the working member 26 is further provided with a foolproof mechanism to prevent the working member 26 from being incorrectly mounted to the connecting part 36. For example, different from the correct mounting state of FIG. 5 (or FIG. 1), when the user mounts the working member 26 to the connecting part 36 in a front-rear reverse manner shown in FIG. 15, the guiding structure 48 becomes to be located at the rear half body of the working member 26. In such arrangement, during the process of the second rail 24 being moved relative to the first rail 22 from the second predetermined position P2 to the first predetermined position P1 along the second direction D2, the rear end part r2 of the second rail 24 will directly hit the working member 26 due to the front half body of the working member 26 having the second transverse height H2, such that the second rail 24 is blocked by the working member 26 and is difficult to (or unable to) return to the first predetermined position P1. Therefore, the user can be aware that the working member 26 is incorrectly mounted to the connecting part 36.

Figure 4:
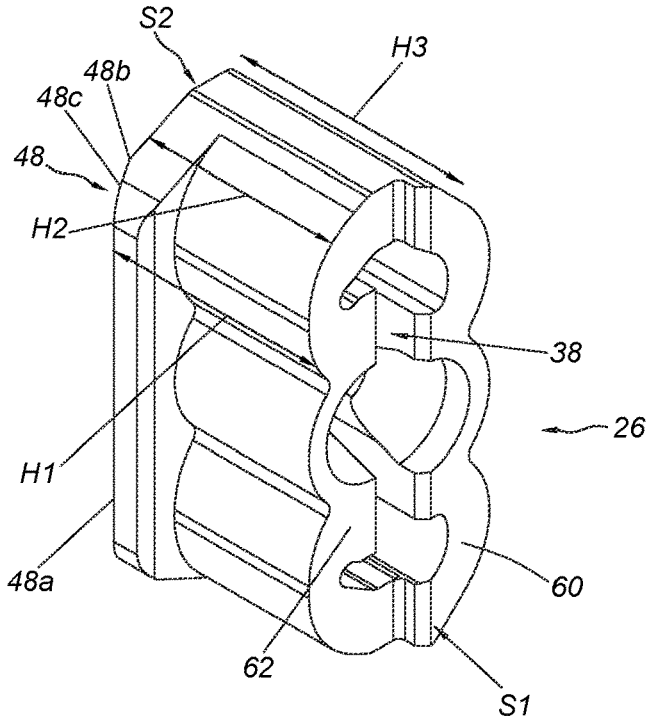
FIG. 4 is a diagram showing the working member from another viewing angle according to an embodiment of the present invention.

As shown in FIG. 4, the first side S1 of the main body of the working member 26 is provided with a step feature. The step feature can be a protrusion part 60 transversely protruded relative to a surface 62 of the first side S1. The protrusion part 60 is configured to increase a transverse height of a predetermined part of the first side S1, such that a third transverse height H3 (or a third lateral height) is defined between the predetermined part of the first side S1 of the working member 26 and the second side S2, and the third transverse height H3 is greater than the second transverse height H2. If the user mounts the working member 26 to the connecting part 36 by reversing to the first side S1 and the second side S2, during the process of the second rail 24 being moved relative to the first rail 22 from the second predetermined position P2 to the first predetermined position P1 along the second direction D2, the predetermined part with the third transverse height H3 becomes to be arranged at the front half body of the working member 26, such that the rear end part r2 of the second rail 24 will directly hit the predetermined part of the working member 26. Therefore, the second rail 24 is blocked by the working member 26 and is difficult to (or unable to) return to the first predetermined position P1. Therefore, the user can be aware that the working member 26 is incorrectly mounted to the connecting part 36.

Therefore, the slide rail assembly 20 according to the embodiments of the present invention is characterized in that:

1. The first space G1 is defined between the working member 26 and the connecting part 36. During the process of the second rail 24 being moved relative to the first rail 22 from the first predetermined position P1 to the second predetermined position P2 along the first direction D1, the contact feature 28 is configured to contact the working member 26, such that the working member 26 is flexibly deformed through the first space G1, in order to allow the contact feature 28 to cross the working member 26 along the first direction D1.

2. When the slide rail assembly 20 is in the retracted state (the second rail 24 is retracted relative to the first rail 22), the working member 26 is configured to block the contact feature 28 in order to prevent the second rail 24 from being moved from the first predetermined position P1 along the first direction D1. Or, during the process of the second rail 24 being moved relative to the first rail 22 from the second predetermined position P2 along the second direction D2, the rear contact part 28*b* of the contact feature 28 is configured to contact the second guiding section 46 of the working member 26 (as shown in FIG. 13) for buffering, so as to reduce collision noise in the process of the second rail 24 being retracted relative to the first rail 22.

3. The working member 26 has a supporting section 42 configured to abut against the connecting part 36, such that the working member 26 can be tightly pressed to the connecting part 36. Preferably, the supporting section 42 of the working member 26 is engaged with the edge wall of the through hole 43 of the connecting part 36.

4. The first longitudinal distance of the first space G1 is substantially smaller than the second longitudinal distance of the second space G2. Therefore, when the working member 26 is correctly mounted to the connecting part 36 (as shown in FIG. 9 and FIG. 13), the contact feature 28 is configured to contact the rear half body of the working member 26 during the process of the second rail 24 being moved relative to the first rail 22 from the first predetermined position P1 to the second predetermined position P2 along the first direction D1. Since the rear half body of the working member 26 has a smaller flexible deformation level through the first space G1 (as shown in FIG. 9), the second rail 24 cannot be easily (or freely) pulled out by the user from the first predetermined position P1 along the first direction D1. On the other hand, during the process of the second rail 24 being moved relative to the first rail 22 from the second predetermined position P2 to the first predetermined position P1 along the second direction D2, the contact feature 28 is configured to contact the front half body of the working member 26. Since the front half body of the working member 26 has a greater flexible deformation level through the second space G2 (as shown in FIG. 13), the second rail 24 can be easily retracted to the first predetermined position P1 along the second direction D2.

5. The working member 26 has a foolproof mechanism to prevent the working member 26 from being incorrectly mounted to the connecting part 36.

6. During the process of the second rail 24 being moved relative to the first rail 22 from the second predetermined position P2 to the first predetermined position P1 along the second direction D2, the guiding structure 48 of the working member 26 is configured to guide the longitudinal wall 56 of the rear end part r2 of the second rail 24, such that the longitudinal wall 56 of the second rail 24 can be supported by the second side S2 of the working member 26 when the second rail 24 returns to the first predetermined position P1.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly, comprising:

a first rail;

a second rail longitudinally movable relative to the first rail;

a working member mounted to a connecting part transversely arranged on one of the first rail and the second rail; and a contact feature arranged on the other one of the first rail and the second rail;

wherein the connecting part has a first side and a second side opposite to the first side, a first space is defined between the working member and the first side of the connecting part, and a second space is defined between the working member and the second side of the connecting part;

wherein during a process of the second rail being moved relative to the first rail from a first predetermined position to a second predetermined position along a first direction, the contact feature is configured to contact the working member, such that the working member is flexibly deformed through the first space, in order to allow the contact feature to cross the working member along the first direction;

wherein during a process of the second rail being moved relative to the first rail from the second predetermined position to the first predetermined position along a second direction opposite to the first direction, the contact feature is configured to contact the working member, such that the working member is flexibly deformed through the second space, in order to allow the contact feature to cross the working member along the second direction;

wherein the working member has different flexible deformation levels through the first space and the second space respectively.

2. The slide rail assembly of claim 1, wherein the working member is made of a flexible material.

3. The slide rail assembly of claim 2, wherein a first longitudinal distance is defined by a maximum longitudinal distance between the first side of the connecting part and a first edge wall of the working member in the first space, and a second longitudinal distance is defined by a maximum longitudinal distance between the second side of the connecting part and a second edge wall of the working member in the second space; the first longitudinal distance is substantially shorter than the second longitudinal distance.

4. The slide rail assembly of claim 2, wherein the working member comprises a first part, a second part and a middle part connected between the first part and the second part, and a first clamping feature is arranged between the first part and the middle part and configured to clamp the first side and the second side of the connecting part.

5. The slide rail assembly of claim 4, wherein the middle part has a supporting section configured to abut against one of the first side and the second side of the connecting part.

6. The slide rail assembly of claim 1, wherein the working member has a foolproof mechanism configured to prevent the working member from being mounted to the connecting part incorrectly.

7. The slide rail assembly of claim 2, wherein each of the first rail and the second rail comprises a first wall, a second wall and a longitudinal wall connected between the first wall and the second wall, and the working member is arranged with a guiding structure; wherein during the process of the second rail being moved relative to the first rail from the second predetermined position to the first predetermined position along the second direction, the guiding structure of the working member is configured to guide the longitudinal wall of the second rail, such that the longitudinal wall of the second rail is configured to be supported by the working member; wherein the guiding structure is an inclined surface or an arc surface.

8. A slide rail assembly, comprising:

a first rail;

a second rail movable relative to the first rail;

a working member detachably mounted to a connecting part of the first rail, wherein the connecting part is transversely protruded from a longitudinal wall of the first rail, and the connecting part has a first side facing toward a rear end part of the first rail and a second side facing toward a front end part of the first rail; and a contact feature arranged on the second rail;

wherein a first space is defined between the working member and the first side of the connecting part, and a second space is defined between the working member and the second side of the connecting part;

wherein when the second rail is moved relative to the first rail along a first direction from a retracted state, the working member is configured to block the contact feature in order to prevent the second rail from being moved from a first predetermined position along the first direction;

wherein the working member has a first flexible deformation level through the first space smaller than a second flexible deformation level through the second space.

9. The slide rail assembly of claim 8, wherein the working member has a first guiding section; wherein during a process of the second rail being moved relative to the first rail from the first predetermined position to a second predetermined position along the first direction, the contact feature is configured to contact the first guiding section of the working member, such that the working member is flexibly deformed through the first space, in order to allow the contact feature to cross the working member.

10. The slide rail assembly of claim 9, wherein the working member further has a second guiding section; wherein during a process of the second rail being moved relative to the first rail from the second predetermined position to the first predetermined position along a second direction opposite to the first direction, the contact feature is configured to contact the second guiding section of the working member, such that the working member is flexibly deformed through the second space, in order to allow the contact feature to cross the working member.

* * * * *